US005259124A

United States Patent [19]

Poterala

[11] Patent Number: 5,259,124

[45] Date of Patent: * Nov. 9, 1993

[54] OPEN TOP COMPACT DRYER OVEN FOR A WEB

[76] Inventor: Robert J. Poterala, 140 Rocky Point, Greenville, S.C. 29615

[ * ] Notice: The portion of the term of this patent subsequent to Mar. 6, 2007 has been disclaimed.

[21] Appl. No.: 471,791

[22] Filed: Jan. 29, 1990

Related U.S. Application Data

[63] Continuation-in-part of Ser. No. 206,853, Jun. 15, 1988, Pat. No. 4,905,381.

[51] Int. Cl.[5] ..... F26B 13/00

[52] U.S. Cl. ..... 34/155; 34/242; 49/490.1

[58] Field of Search ..... 34/156, 155, 154, 23, 34/242; 432/59; 49/490.1

[56] References Cited

U.S. PATENT DOCUMENTS

| | | | |
|---|---|---|---|
| 2,144,919 | 1/1939 | Gautreau | 34/156 |
| 3,971,235 | 7/1976 | Frezza | 34/242 |
| 4,575,952 | 3/1986 | Bodenan et al. | 34/156 |
| 4,594,795 | 6/1986 | Stephansen | 34/156 X |
| 4,905,381 | 3/1990 | Poterala | 34/155 |

FOREIGN PATENT DOCUMENTS

| | | | |
|---|---|---|---|
| 2132324 | 7/1984 | United Kingdom | 34/156 |

*Primary Examiner*—Henry A. Bennet
*Attorney, Agent, or Firm*—Cort Flint

[57] ABSTRACT

A compact web dryer oven, (A,A') is disclosed which is heat efficient, may be open for convenient cleaning, and raises automatically under the effects of an explosion to relieve pressure and reduce damage to the oven interior. The oven includes a lower housing (B) and an upper housing (C) which are essentially identical. Each housing includes an air distribution system having a short path and recycle time which may include a hot air discharge blower (H,110,112,114), and an air distributing plenum (I, 116). Lower and upper hot air registers (E,F) receive the proportioned air flow. The air registers include spaced tubular members (22) transverse to the air diffuser manifold having an air divider nozzle (G) positioned between each member. A first nozzle (32), second nozzle (34), and third nozzle (42) are defined relative to tubular members (22) and nozzle bodies (G) which accelerate the flow of air in a manner to balance the air currents at the web. Air returns through slots (50,50') to air return chamber (130) in a closed loop so each hot air register can operate at a different temperature to treat dissimilar sides of a web. Isolated air return chambers (**154*a*,156*a*,158*a*) define a series of drying sections (154,156,158) in each housing. Intake and exhaust ports (171,177**) establish a slightly higher negative pressure in the hot air register of each section to facilitate web travel.

36 Claims, 9 Drawing Sheets

OPEN TOP COMPACT DRYER OVEN FOR A WEB

CROSS-REFERENCED TO RELATED APPLICATION

This application is a continuation-in-part of co-pending application Ser. No. 206,853 entitled OPEN TOP COMPACT DRYER OVEN FOR A WEB filed on Jun. 15, 1988 now U.S. Pat. No. 4,905,381.

BACKGROUND OF THE INVENTION

The invention relates to an improved dryer oven for a textile web and other sheet-like material which is constructed for higher efficiency and cleanability.

In the textile industry, it is common to dry a traveling textile web by passing it through a dryer oven on tenter chains. Other industries also use ovens for drying sheet-like material which travels through the oven. Normally, the ovens are quite large and require that an attendant enter the oven in order for it to be cleaned of waste, dust, and other contaminant particulate matter. In the case of drying fabrics containing volatiles, the residual condensed vapors must often be cleaned from the oven parts, burners, etc. The interior of the typical dryer oven has been constructed as a large box, for example, see U.S. Pat. Nos. 4,295,284. An average housing for a textile tenter oven is 90 feet in length, 15 feet in width, and 7 feet in height. The oven also includes up to three penthouses on top which house burners, etc., each penthouse is about 10 feet in length, 15 feet in width, and 8 feet in height. The oven housing is not compact and the attendant must enter the large and dark housing in order to clean the parts. The large size and thermal mass in oven structure normally do not allow for the oven to cool down in time for cleaning. Because of the nature of the cleaning operation and the necessity of entering the large housing box, the oven is not cleaned or the attendant often does not perform a thorough job because the oven is still hot or warm, reducing the efficiency and life of the oven. If volatile ovens are not cleaned properly, they can quite easily catch on fire resulting in damage and danger. Explosions quite often result in oven damage. The drying efficiency of the prior art heater ovens is a problem to which little attention has been given. Attention has been somewhat diverted from the problems of cleanability and efficiency and drawn instead to the other mechanical aspects associated with conveying the fabric through the large housing box while contacting opposing sides of the web or sheet material with hot air.

Typically, the textile web drying ovens have consisted of one large housing in which two superposed dryer units are arranged between which the web travels. A plurality of spaced hot air ducts normally are used across the dryer units transverse to the direction of web travel as shown in U.S. Pat. No. 3,739,491. Once the hot air leaves the ducts, it impinges upon the top and bottom of the web. Air control in this area is crucial to the dryer efficiency and performance. Uniform drying of each side of the web is critical. If drying is uneven, streaking or shading of dyed fabrics may result through wicking of the dye. In the case of coated fabrics like latex coated furniture fabrics, the coating will overcure in some areas while undercure in other areas when the drying rate is not uniform. After the fabric is converted to furniture, fabric shading occurs in the areas of overcuring resulting in customer complaints and returned furniture. In other applications, it may be desirable to subject opposite sides of a web to different drying temperatures.

Due to the fact that there are many different types of fabric which now need to be dried on the same dryer, many dryers are being made with variable speed blowers to accommodate the different fabrics on the same dryer. However, the existing single nozzle type of air distribution system is still being used in combination with the variable speed blower. The result is the development of eddy currents at certain speeds which result in unbalanced air distribution and uneven drying.

Various structures and methods are used to impinge the hot air upon the traveling web. The single nozzle distribution system is typical of that shown in U.S. Pat. Nos. 4,516,332 and 4,523,391. U.S. Pat. No. 2,144,919 discloses an arrangement of a web drying oven wherein hot air is distributed between transverse ducts, rather than through the ducts as in Pat. No. 3,739,491. In the '919 patent, the ducts return the air after contacting the traveling web. The ducts are contoured to provide special air flow treatment of the air passing between the ducts to contact the web. In particular, the ducts are shaped to define nozzles which deliver the jets of hot air against the web at angles from 20–30 degrees. U.S. Pat. No. 3,678,599 discloses particular arrangements of air ducts with a perforated concave rib between adjacent ducts. This arrangement is said to stabilize the web moving longitudinally. In this arrangement, the transverse ducts are used for the return of air rather than distribution of hot air. Slot shaped openings are defined at the ends of the rib which direct the hot air in opposite directions. The ducts are said to consist of airfoil sections. The selection of the cross-section of the perforations in the ducts and the vacuum inside the ducts is said to control desired flow conditions. However, this results in a relatively theoretical and complicated determination of air flow characteristics which may not be susceptible of exact determination or practical embodiment. There is also a space between adjacent pairs of ducts in which there is no flow treatment. U.S. Pat. No. 3,060,594 discloses an apparatus for drying webs with hot air or other medium in which provision of a desired air flow pattern is sought to accomplish contact-free and tension-free guiding and drying of webs freely floating within a treatment chamber. In this case, air is discharged from transversely extending ducts and is returned between the ducts.

Various arrangements have been provided for forcing the hot air into the dryer sections. Dual blowers are shown in U.S. Pat. No. 4,137,649 and a single blower is shown in U.S. Pat. No. 4,516,332. Typically, these blowers deliver the air through trapezoidal shaped boxes as illustrated in the aforesaid patents. The air may be heated by a burner or conventional means and taken in by the intake side of the blower. The hot air taken in may also be mixed with the return air from the dryer sections as illustrated in the '332 patent. A single source of heat may be used such as in U.S. Pat. No. 4,551,928, or plural sources of heat may be used such as shown in the '649 patent, one each for the two blowers.

Accordingly, an important object of the invention is to provide a compact dryer oven for a web and the like material which provides balanced hot air distribution for even drying of the web.

Another object of the invention is to provide a compact dryer oven for a web and the like material having superposed oven housing which may be operated at different temperatures to subject opposite sides of the web to different drying conditions.

Another object of the invention is to provide a compact dryer oven for a web and the like material having superposed oven housing with air flow characteristics which facilitate travel of the web between the housings and through the oven while floated by air.

Another object of the invention is to provide a web drying oven which is compact and easily cleanable.

Another object is to provide a compact web drying oven having a minimum interior volume so that accumulations of volatile vapors is reduced and a releasable upper housing that will open should an explosion occur to reduce dryer damage.

Another object of the present invention is to provide a dryer oven for a web and like sheet material which is compact and has an upper pivotal housing which may be opened for access to clean the oven without the need of entering the dryer box.

Another object of the invention is to provide a dryer oven for a web and the like material having improved hot air flow distribution for more efficient drying and support of the web traveling through the treatment section of the oven.

Another object of the invention is to provide a dryer oven for a web and the like material which is compact and has a closed circuit air distribution system with a short path which eliminates the use of long supply ducts and increases the number of air changes per minute to provide more efficient and protective use of blower horsepower and a lower temperature differential between supply air and return air, all of which enhances the efficiency of the oven.

Another object of the invention is to provide a dryer oven for a web and the like material having a hot air distribution system which uses a plurality of separate nozzle orifices which balance the air distribution and provide a combination tangential and center lift air flow relative to the traveling web which accelerates drying rates without using high air forces that would tend to push down the pile of pile fabrics and push in the chemical compounds of coated fabrics.

Another object of the invention is to provide a compact dryer oven for a web and the like material in which the interior space and material used within the interior of the oven are both reduced which allows reduced heat mass inside the oven to provide for extremely fast start-up times and low energy consumption.

SUMMARY OF THE INVENTION

A compact dryer oven is disclosed for a traveling web and the like which may be easily cleaned without entering the oven and which is reduced in interior space and structure for more efficient drying. The oven comprises a lower fixed housing and an upper pivotal housing which may be opened to expose both housings for cleaning without entry. The oven has a compact volume to reduce build up of explosive vapors and the upper housing releases in a pivotal action in the event of an explosion. The web travels between the lower and upper housings. Advantageously, each housing includes an identical hot air distribution system so the web is dried evenly on both sides. Alternately, since each hot air distribution system is independent, the oven housings may be operated at different temperatures to treat each side of the web differently. This is particularly advantageous where the sides of the web are dissimilar. Each housing includes a hot air discharge device carried in the housing for discharging hot air into the housing. An air diffuser manifold may be carried in the housing which extends longitudinally in the direction of web travel. The diffuser manifold receives the discharged hot air and distributes the air radially in equal parts across the width of the web. The air diffuser manifold is carried centrally in an upper part of an air equalizing chamber in the housings which receives the proportioned air flows. A hot air register is carried below the diffuser manifold means across a lower part of the air equalizing chamber. The hot air register includes a plurality of longitudinally spaced tubular members extending laterally across the diffuser manifold and spaced longitudinally in the direction of web travel. An air dividing nozzle is carried between adjacent tubular members for splitting the hot air passing between adjacent tubular members into a first air flow and a second air flow, generally tangential to the web and in opposite directions. The air flows are returned, after traveling a short path, through the tubular members. The air dividing nozzle includes a divider body, and a first nozzle opening between adjacent tubular members upstream of the divider body. There is a second nozzle opening between the divider body and the adjacent tubular members having an area less than the area of the first nozzle opening so that the hot air increases in velocity as it passes through the second nozzle. An expansion zone follows the second nozzle opening having an area greater than the second nozzle to decrease the velocity of the hot air. A third nozzle is created between the divider body and the adjacent tubular members below the expansion zone which has an area less than the area of the expansion zone to increase the velocity of hot air. The series of increasing, decreasing and increasing velocities and pressure of the hot air balances the distribution of hot air delivered through the lower and upper hot air registers so that the web is evenly dried. The tubular members include an air return slot extending longitudinally along the length of the tubular members facing the web for return of air from the first and second air flows. One end of the tubular members is connected to an intake of a heater which supplies heated air to the air discharge device.

Uniform and tangential air flow provides accelerated drying rates for surface sensitive fabrics. The two direction air flow pattern provides a center vacuum which has a lifting action to pile type fabrics. One air jet blows left to right and another air jet blows right to left. Therefore, there is no tendency to force fabric pile in a fixed direction. The air flow also provides advantages to fabrics which have been coated with latex rubber or some other form of chemical compound, the combination tangential flow with center left allows accelerated drying rates without using high air force which would have a tendency to push the chemical compounds into the fabric. Extremely uniform air flow by use of separate nozzle orifices level and balance air distribution on the web. Slotted air return orifices move air from the nozzle air jets directly to the return air tubes in the direction parallel with fabric direction. A special hinged upper housing allows the whole dryer upper section to be lifted to facilitate cleaning and maintenance without requiring operators to enter a dark, usually hot enclosure, thereby reducing the clean-up time. A short circuit air system allows for an extremely reduced air supply and return path without the use of long supply ducts, thereby increasing the number of air changes per minute providing more effective use of fan horsepower and a lower temperature differential between supply air and return air. Elimination of space consuming ducting allows reduced heat mass, thereby providing extremely fast start-up and low energy consumption.

An intake and exhaust system maintains equilibrium in the oven and , by means of dividing the housings into a series of sections defined by isolated air return chambers, sequentially higher negative pressures are provided which facilities floating of the web through the oven without contact.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
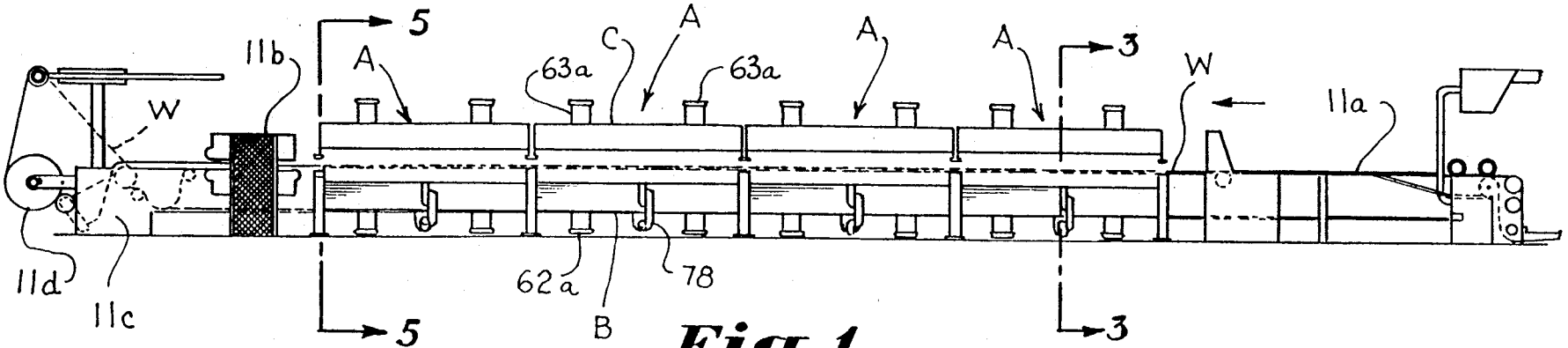
FIG. 1 is a front elevation illustrating a series of dryer ovens constructed in accordance with the invention arranged side by side for drying a continuous web traveling through the ovens.

Referring now in more detail to the drawings, a compact dryer oven is illustrated, designated generally as A, for drying a traveling web W and other sheet-like material which may be easily cleaned without entering the oven and is reduced in interior space and structure for more efficient drying and safety. As can best be seen in FIG. 1, one or more ovens A may be arranged in tandem, four in FIG. 1, for drying the web. The number of ovens used depends on the application being made. It has been found according to the invention that twice the drying may be had with the tandem arrangement as compared to the prior textile ovens having equivalent floor space. In the illustrated application, web W passes through a coater 11*a*, the series of dryer ovens A, and a cooler 11*b*, to a winder 11*c* where the web is taken up on a roll 11*d*. As can best be seen in FIG. 7, the oven comprises a fixed lower oven housing B and a movable upper oven housing C disposed above the lower oven housing. Pivot support means D is provided for pivotally carrying upper oven housing C above lower oven housing B between a closed position (FIG. 3) in which web W travels between the housings for drying, and an open position (FIG. 2) in which housing C is raised and access can be had to an interior, designated generally as 10, of the lower and upper oven housings for cleaning of the interiors. Lower and upper oven housings, B and C, consist of lower and upper housing enclosures 12B and 12C having lower and upper housing openings, designated generally as B, 14B and 14C (FIG. 3). Lower housing opening 14B faces upper housing opening 14C and web W travels across the lower and upper housing openings through the oven. A lower hot air register E is carried generally co-extending across lower housing opening 14B and upper hot air register F is carried generally co-extending across upper housing opening 14C from which hot air, shown by arrows 16, is delivered for contacting and drying lower side 20B and upper side 20C of web W, respectively.

Figure 3:
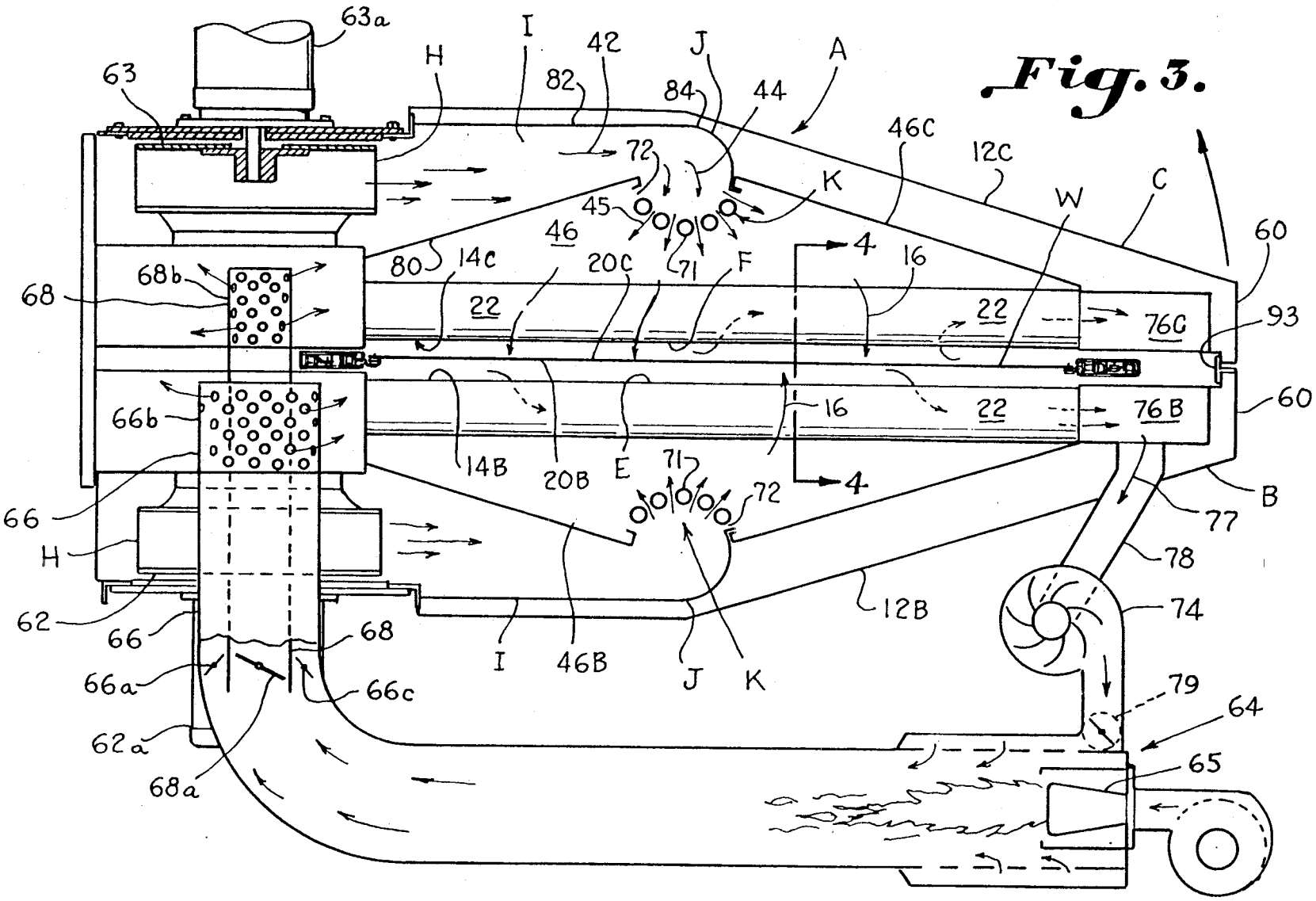
FIG. 3 is a sectional view taken along line 3—3 of FIG. 1.
Figure 4:
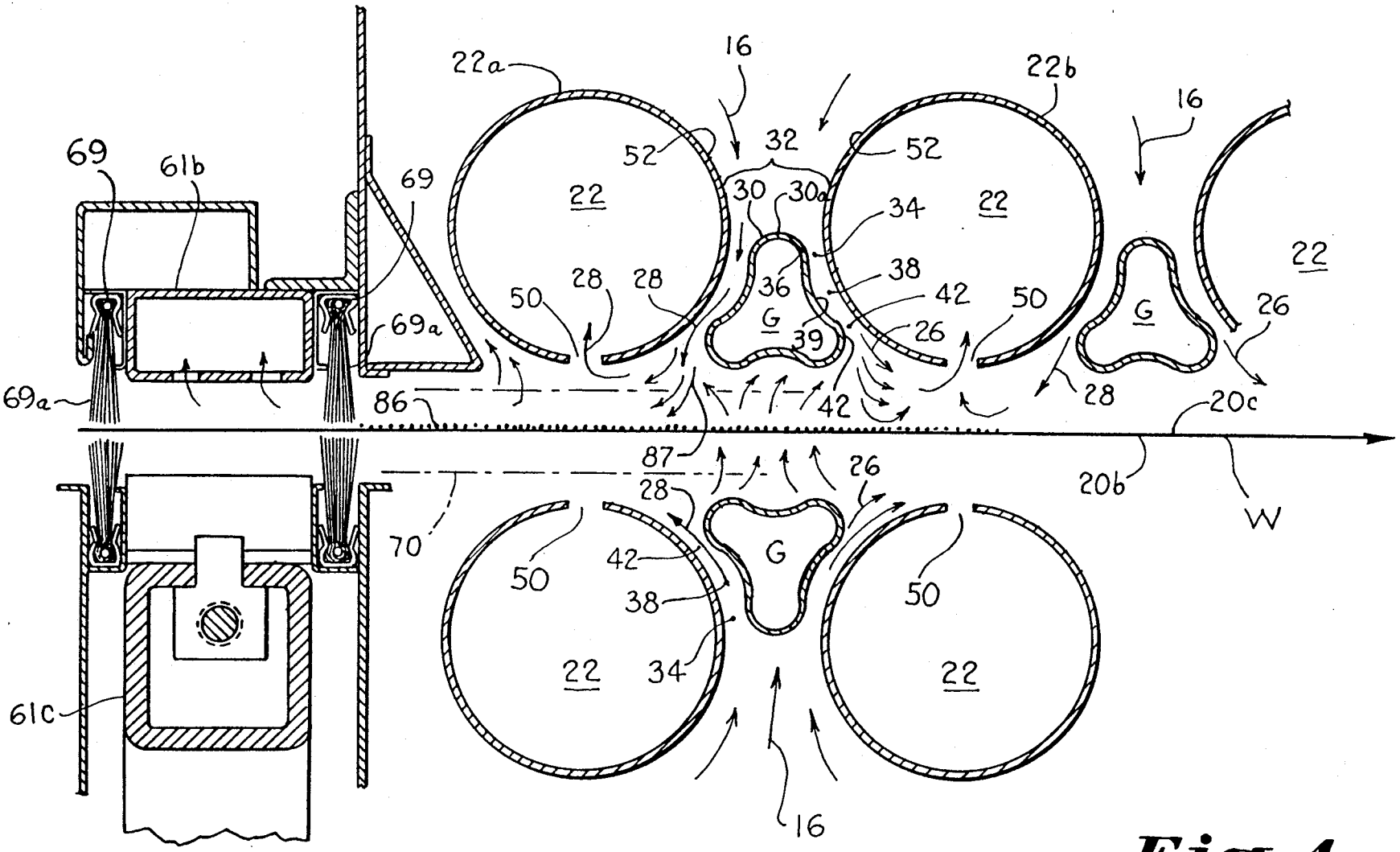
FIG. 4 is a sectional view taken along line 4—4 of FIG. 3 illustrating the air divider assembly of the present invention.

As can best be seen in FIGS. 3 and 4, each lower and upper hot air register E,F includes a plurality of tubular members 22 carried across lower and upper housing openings 14C and 14B spaced longitudinally in the direction of web travel. Tubular members 22 are used to return air which will be explained later. Air dividing nozzle means G is carried between adjacent tubular members 22, i.e. 22*a* and 22*b*, for splitting hot air 16 passing between the adjacent tubular members into a first air flow 26 and a second air flow 28 generally tangential to web W and in opposite directions. Air dividing nozzle means G includes a divider body 30 having a nose 30*a* which splits the hot air flow in half. There is a first nozzle opening 32 between the adjacent tubular members upstream of divider body 30. A second nozzle, designated generally as 34, defined between divider body 30 at a convex part 36 and adjacent tubular members 22*a*, 22*b* having an area less than the area of first nozzle opening 32 so that the hot air increases in velocity passing through nozzle 34. An expansion zone 38 follows second nozzle opening 34 between a concave portion 39 and adjacent tubular members having an area greater than second nozzle 34 to decrease the velocity of the hot air. A third nozzle, designated generally as 40, is defined between said divider body 30 at a convex part 42 and adjacent tubular members 22*a*, 22*b* having an area less than the area of expansion zone 38 to increase again the velocity of the hot air flow. The series of increasing, decreasing and increasing changes in velocity and pressure of the hot air passing through second nozzle 34, expansion zone 38, and third nozzle 40 levels and balances the distribution of hot air delivered through lower and upper hot air registers E and F so that web W is evenly dried. The unique design of the double nozzle 34, 40 air flow system yields a highly leveled air distribution without significant resistance, resulting in high efficiency. This unique design also offers the advantage of automatic nozzle cleaning of the orifices due to the resultant pressure changes which tend to blow out accumulated lint.

Reference will now be had to the entrance of drying air into lower and upper housings B and C. Since the air distribution system is identical for each housing, reference will be made only to upper housing C for purposes of explanation. As can best be seen in FIG. 3, each housing includes hot air discharge means H for discharging hot air into the housing. A reducing plenum means I receives hot air and reduces the air into a generally steady horizontal air flow 42. Air redirecting means J receives the horizontal air flow 42 and directs the horizontal air flow into a generally vertical air flow 44. A diffuser manifold means, designated generally as K, receives the vertical air flow 44 for separating and proportioning the air flow into generally equal parts and directing proportioned air flow 45 into an equalizing chamber 46, i.e. lower and upper equalizing air chambers 46B and 46C, respectively.

Diffuser manifold K distributes a plurality of equal air flows 45 radially across the width of chambers 46B and 46C so that hot air is supplied evenly across the width of web W passing between lower and upper air registers E and F. Means for splitting the proportion air flows 45 includes tubular members 22 and air divider nozzles G spaced across the enclosure openings 14B, 14C, which are the openings of equalizing chambers 46B and 46C, for receiving proportioned air flows 45 and dividing the air flow into first air flows 26 in the direction of web travel and second air flows 28 opposite to the direction of web travel. Uniform and tangential air flow provides accelerated drying rates for surface sensitive fabrics. The two direction air flow pattern provides a center vacuum which has a lifting action to pile type fabrics. Since one air jet blows left to right and another air jet blows right to left, there is no tendency to force fabric pile on a fixed direction. The air flow also provides advantages to fabrics which have been coated with latex rubber or some other form of chemical compound. The combination tangential flow with center lift at 48 allows accelerated drying rates without using high air force which would have a tendency to push the chemical compounds into the fabric.

It has been noted that air equalizing chambers 46B and 46C are carried in lower and upper housing enclosures 14B and 14C surrounding and enclosing lower and upper hot air registers E and F. Longitudinal air return slots 50 are formed along the length of tubular members 22 through which first and second air flows 26 and 28 are exhausted. Tubular members 22 are preferably round and first nozzle 32 is formed by circumferential converging walls 52 of tubular members 22.

Figure 2:
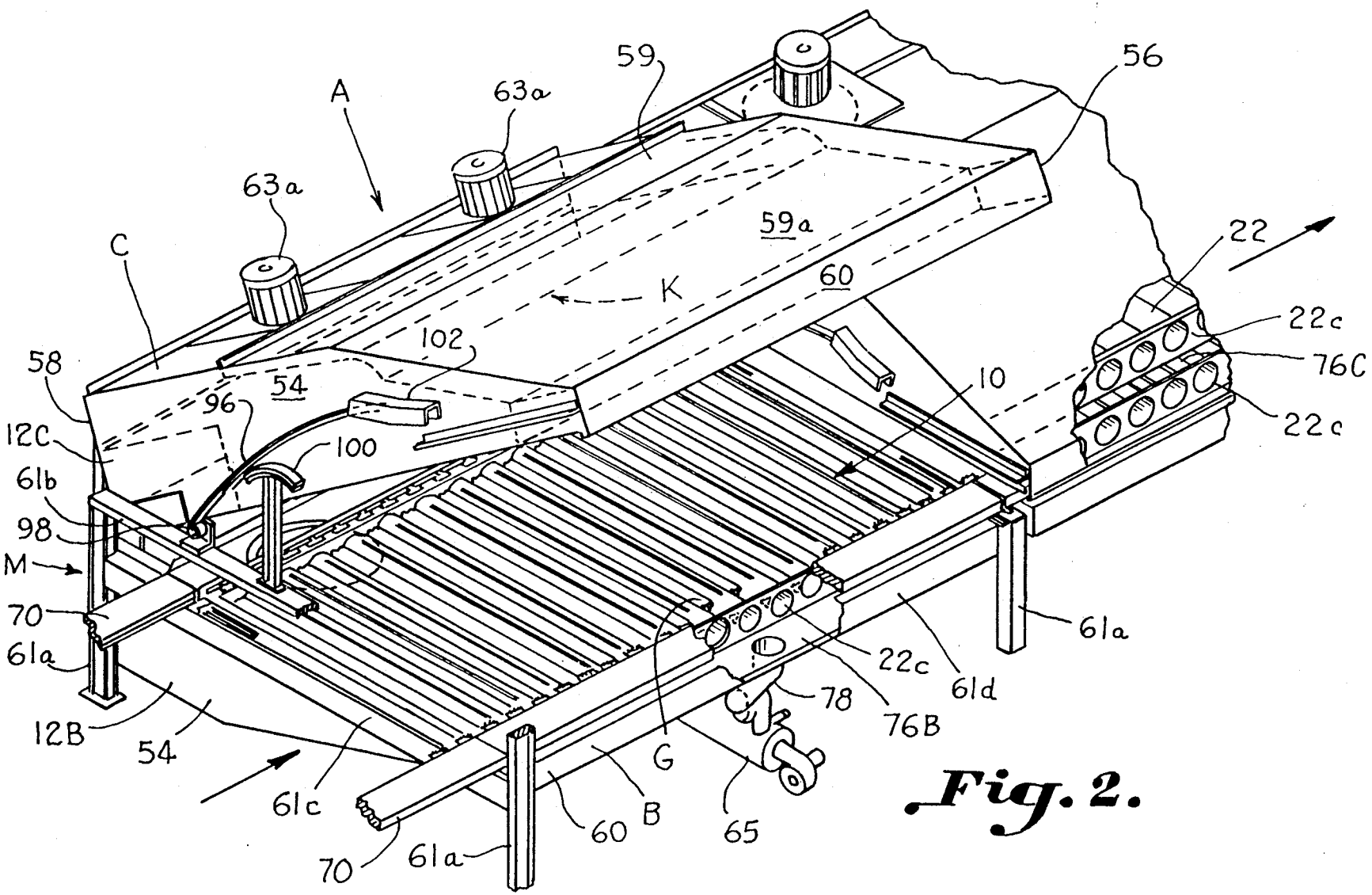
FIG. 2 is a perspective view of a compact dryer oven constructed in accordance with the present invention having a pivotal upper housing.

As can best be seen in FIGS. 2 and 3, each oven housing enclosure 12B, 12C includes a first (front) end wall 54 at which web W enters said oven, a second remote end wall 56 from which the web exits said oven, a back wall 58 integral with the first and second end walls, a top wall 59 integral with the back wall and the end walls which includes an inclined portion **59*a*, and a front wall 60 integral with the top wall and end walls. A frame, designated generally as M, includes legs 61*a*, front end rails 61*b* and 61*c*, and side rails 61*d*** which support housings B and C in a manner which will be more fully explained later.

Air discharge means H includes a pair of first blowers 62 carried in lower housing B and a pair of second blowers 63 carried in upper housing C, and heater means 64 for supplying heated air to each of the blowers 62, 63 for discharge in respective ones of the housings. The blowers are driven by respective electric motors **62*a*,63*a* carried on the housings. Heater means 64 includes a gas burner 65 for heating air and a first heater duct 66 extending into lower housing B between blowers 60 for supplying heated air to the first blowers 60. A second heater duct 68 extends through lower housing B into said upper housing C for delivering heated air to said second blowers 62. First and second heat ducts 66 and 68 are concentric. Second duct 68 is carried within first duct 66 extending through lower housing C into upper housing B exactly between blowers 62. Ducts 66,68 terminate in perforated sections 66*b*,68*b* for distributing air centrally to the blowers. Butterfly valves 66*a* and 68*a* proportion the air flow so it may be equalized to blowers 62, 63, respectively. An efficient end seal system is provided by a flexible brush assembly 69, FIGS. 4 and 5, wherein channel brushes 69*a* are carried by end rails 61*b* at each dryer end 56 and 54 of the end dryers A in the series. The brushes may be carried at the entrance and exits of the end units only, or in the case of one oven, at each end 54, 56. The brushes are constructed of fine gauge wire of stainless steel, brass, or other non-melt materials. Brushes are fitted to meet at the web line. Tenter rails 70 displace brush fibers to form a tight seal around the rail profile. Deflectors 70*a* deflect brush filaments around pin bars 70*b* (or clips on clip tenter) to prevent wear from the pin movement. The web is attached in a conventional manner to pin bars 70*b***. The brushes retain the hot air in the housing.

Diffuser manifold means K includes a radial assembly of elongated cylindrical pipes 71 disposed centrally of equalizing chamber 46 extending longitudinally in the direction of web travel over the length of housing C. The pipes are radially arranged and spaced apart to define radially spaced longitudinally extending slot openings 72 between adjacent pipes through which air is distributed and proportioned equally for equalized distribution across the width of web W. The pipes are preferably hollow pipes having round cross sections. The air return system includes an exhaust blower 74 connected to a blower return duct 76B to which ends 22C of tubes 22 are open and in fluid communication for the return of air. Upper return duct 76C returns air from upper tubes 22 via lower return duct 76B. Return air 77 then goes through duct 78 to exhaust blower 74 and then to burner 65. A diverting valve 79 may be provided to exhaust some return air to ambient rather than recycle. As can best be seen in FIG. 4, air is also drawn off the ends 54,56 through hollow perforated rail **61*b*** attached to suitable suction.

Referring to FIG. 3, redirecting means J includes inclined wall 80, straight wall 82 and a curved wall 84 merging into a curvature of the radially arranged pipes 71 for redirecting air flow vertically through said radial slot openings 72. It is noted that cylindrical diffusers 71 are in a direction parallel to fabric travel. Air then flows from equalizing chamber 46 to nozzles 32 as shown in FIG. 4. The conical surfaces 52 induce the effect of shaping the air flow into a smooth and laminar condition. In the drying and evaporation process with moving web W, a thin air/moisture layer 86 (FIG. 4) travels with the web. Layer 86 substantially inhibits continual heat transfer to the web and further vapor removal by effecting a seal over the web. This layer is broken up by employing air stream 28 tangential to the web which lifts layer 86 and directs it to the vacuum created at slot 50. Secondly, air movement forms a vortex between tubes 22 and nozzle G generally at 87 creating a vacuum. This vacuum helps remove layer 86 and direct it to slot 50. The vacuum also helps to pull vapors within the web to the surface.

The specially shaped nozzle divider G serves to split the air flow into equal streams 26 and 28, which are in opposite direction to each other and due to the curved surface of the return air tubes 22, the discharging air is forced in a direction downward and tangent to the fabric flow which provides both the drying air and, in the case of the lower air system, a support air system. Slots 50 in return air tubes 22 capture this air at the approximate center of the tubes. This provides for a short discharge—drying period after which the hot air is sucked into the tubes 22. Return air tubes 22 are positioned with one end open to the negative pressure of the fan intake.

Figure 6:
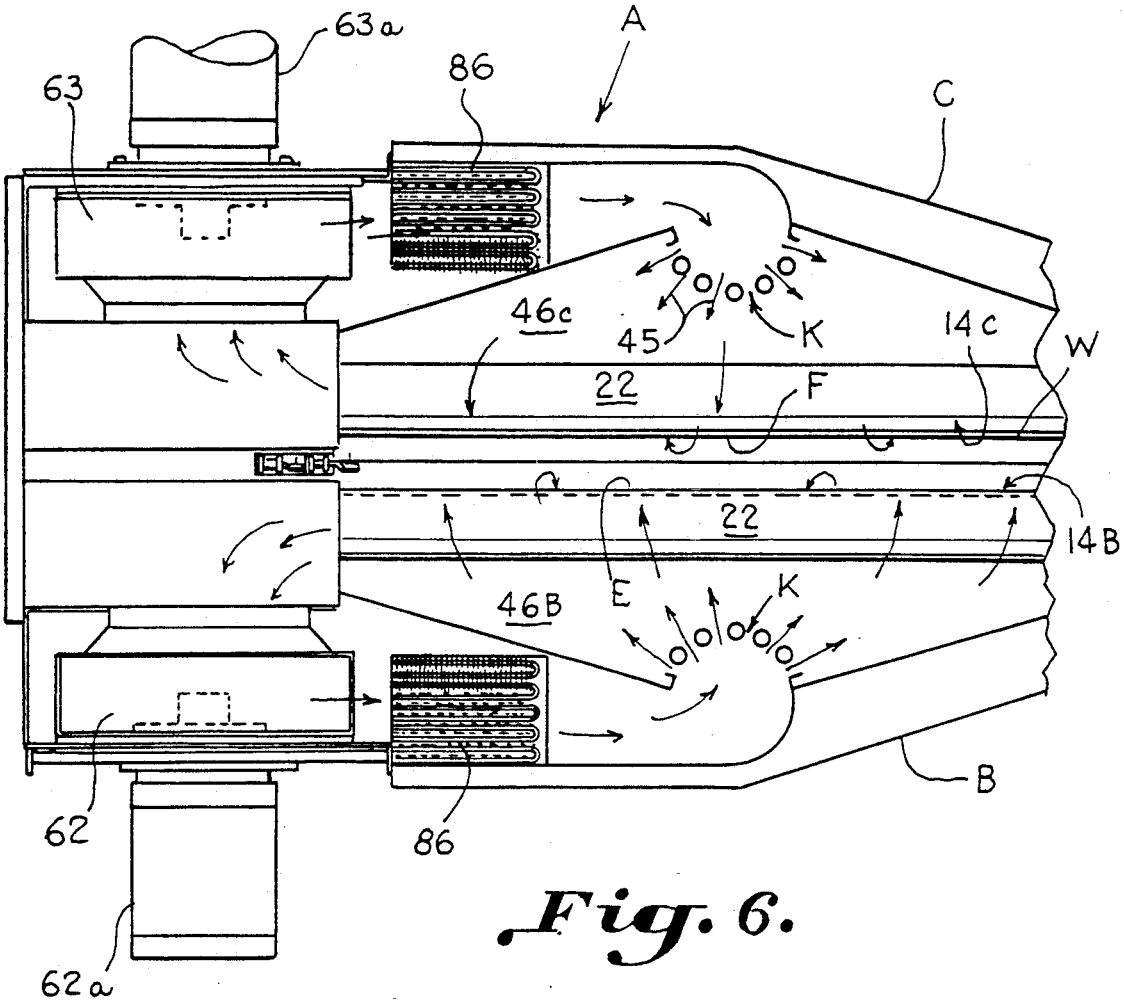
FIG. 6 is a partial section showing another embodiment of an air heater in accordance with the invention.

As can best be seen in FIG. 6, heat may also be applied to the discharge air by electric or steam coils 86 (commercially available) carried by the housings on the discharge sides of blowers 62, 63. Air passing over the hot coils induces heat to the discharge of the blowers and is discharged to the web.

Figure 5:
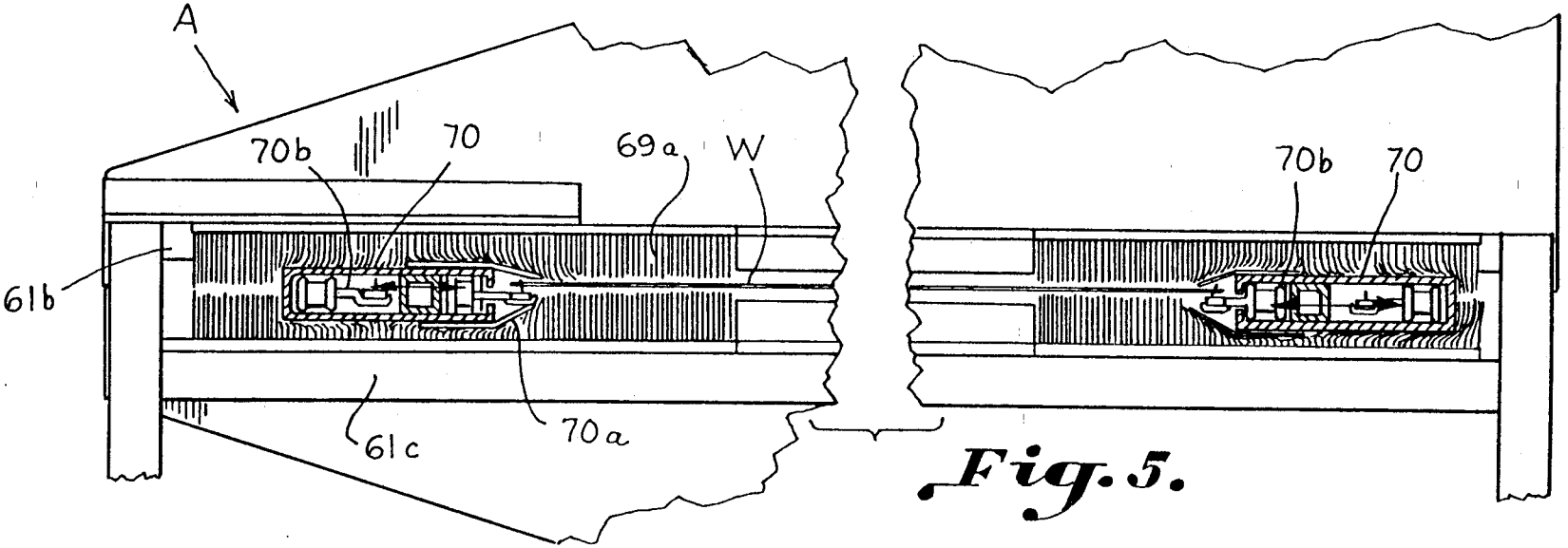
FIG. 5 is a sectional view taken along line 5—5 of FIG. 1.
Figure 7:
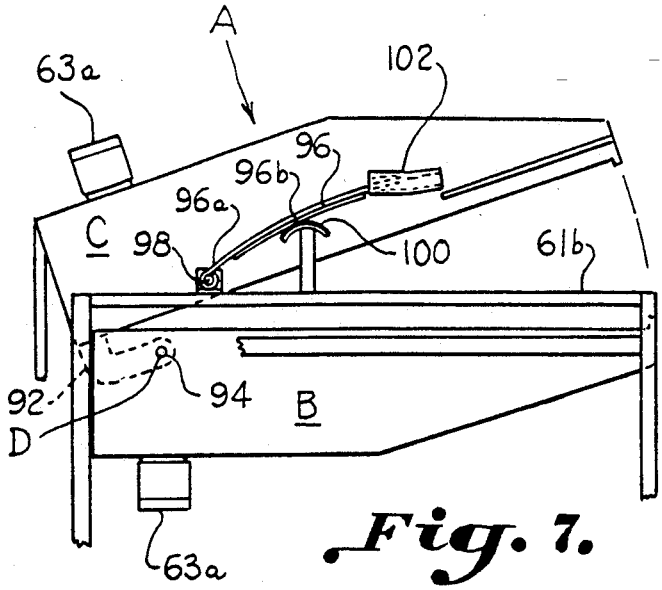
FIG. 7 is a front elevation of a web dryer oven having a fixed lower housing and pivotal upper housing according to the invention.
Figure 8:
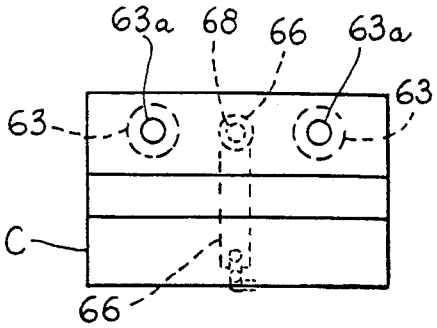
FIG. 8 is a top plan view of the web dryer oven of FIG. 7.
Figure 9:
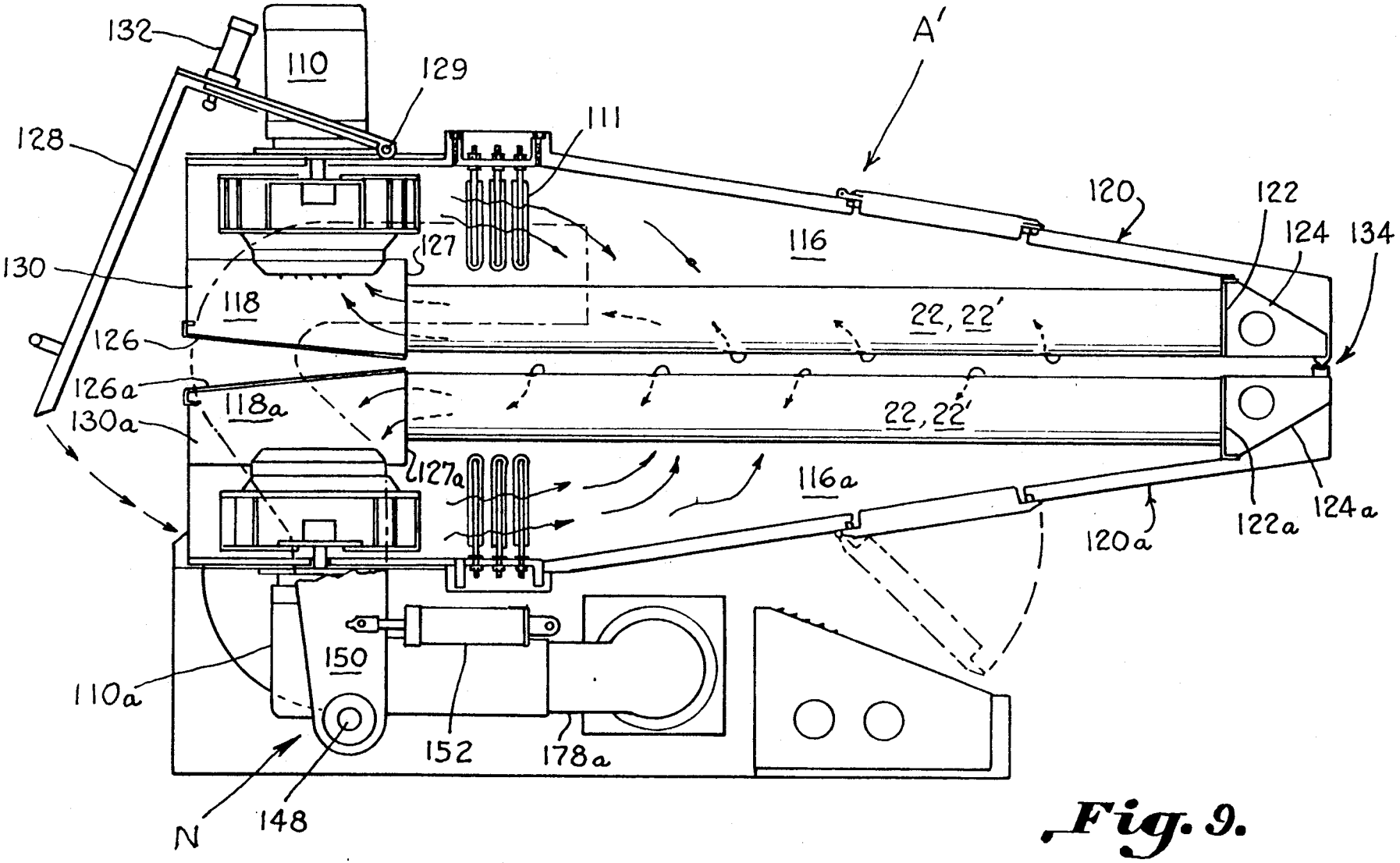
FIG. 9 is a sectional view corresponding to FIG. 3 of an alternate embodiment of a dryer oven constructed in accordance with the present invention.

The releasable, pivotal opening of upper housing C, and the mounting of the housings on the frame M will now be described in reference to FIGS. 2, 5 and 7. An L-shaped flange 90 is carried by each end 54,56 of housing C which rests on end rails 61*b* when upper housing C is closed. It is noted that a sealing strip 93 of suitable heat resistant material extends along the joint of front walls 60 of the lower and upper housings when closed to seal against heat loss. Pivot means D includes a pivot arm 92 affixed to housing C and pivotally attached by pivot pin 94 to lower housing B. Lower housing B is affixed to frame M in any suitable manner such as welding, in an under slung manner. It can be seen then that the interior of housings B and C is greatly reduced in its volume compared to the prior textile dryer and the like ovens. This minimized volume has less tendency for an explosion since the amount of volatile vapors is reduced. However, in the event of an explosion, upper housing will release from its closed position and pivot upwards if sufficient pressure exists to relieve the effects of the explosion and minimize damage to the oven. For this reason, upper housing is provided with a release means N in connected between the housing and frame M which yields to pressure allowing housing C to pivot upwards. Release means N includes a leaf spring 96 having one end 96*a* pivotally attached to end rail 61*b* at a pivot 98. A medial portion 96*b* of the spring slides on a rider 100 affixed to end rail 61*b*. A free end 96*c* is received in a retainer 102 carried by end 54 of housing C. Spring 96 applies a biasing force which assists in the release and raising of the housing requiring only about 50 lbs force to open the housing. Thus, the housing will release and pivot open before the forces of an explosion will damage the interior parts of the oven.

Thus, it can be seen that a highly advantageous construction can be had according to the invention for evenly drying a web and facilitating oven cleaning. Extremely uniform air flow is achieved by use of three separate nozzle orifices 32, 38, and 40 which balance air distribution to web W. Air return slots move air from the nozzle air jets directly to return air tubes in the direction parallel with fabric direction. Prior machines used an open channel whereby the air moved perpendicular to fabric travel, this provides that as the air picked up moisture, it cooled rapidly and was traversed across the fabric, subjecting the edges to a different drying condition than was at the center. Single side mounted fans with central air supply provide the advantage of saving space within the dryer enclosure, the center distributor assures that this air is uniformly distributed to each dryer side. Previous single side designs feed air distribution to only one side. A special hinged housing assembly allows the whole dryer upper housing to be lifted to facilitate cleaning and maintenance without requiring operators to enter a dark, usually hot enclosure, reducing the clean-up time. A short path air system allows for an extremely reduced air supply and return path without the use of long supply ducts, thereby increasing the number of air changes per minute providing more effective use of fan horsepower and a lower temperature differential between supply air and return air. Reduced internal material, i.e., elimination of space consuming ducting, allows reduced heat mass, thereby providing extremely fast start-up and low energy consumption.

Figure 10:
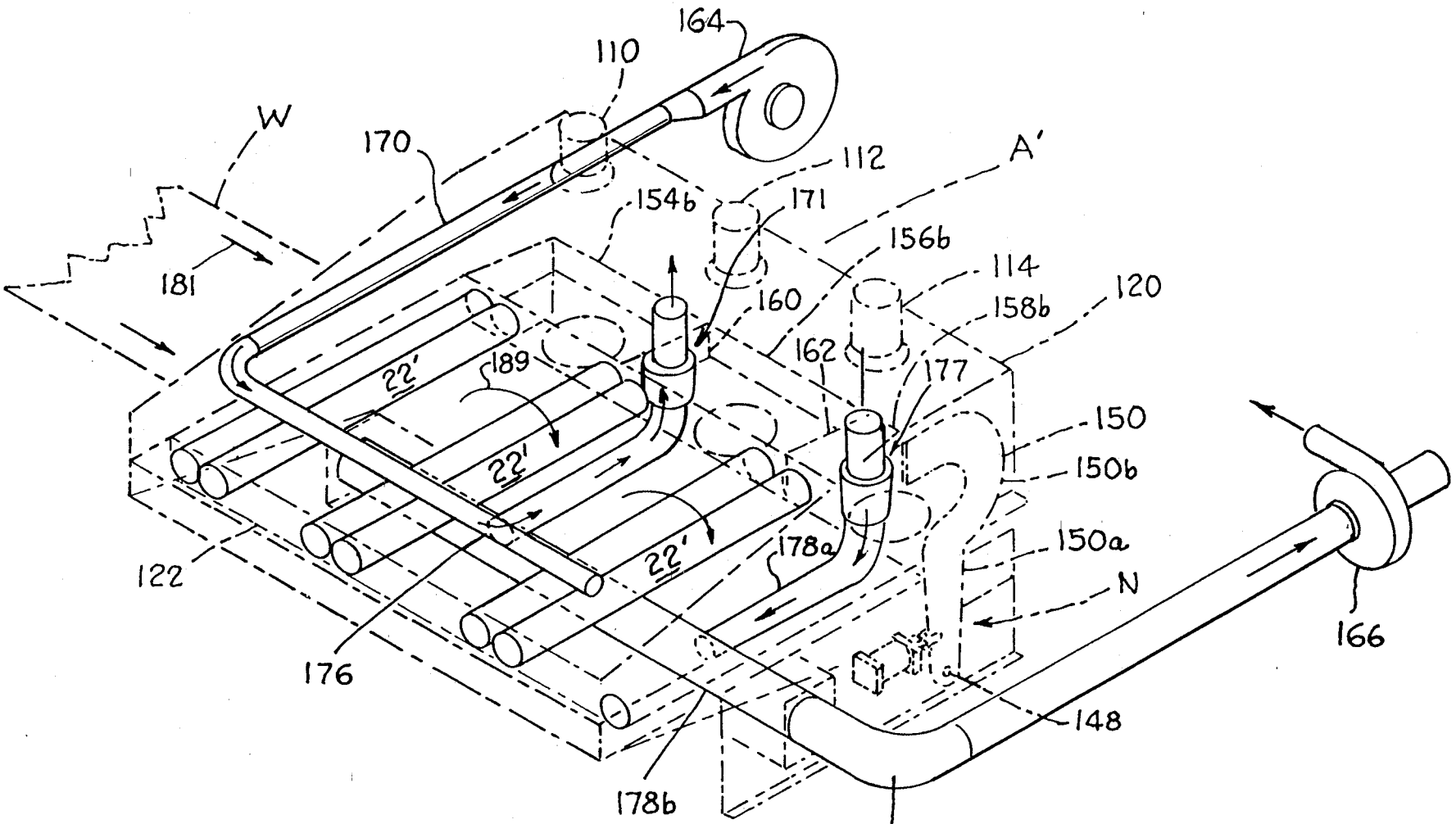
FIG. 10 is a perspective view of the alternate embodiment of the invention shown in FIG. 9 with parts of the oven shown in phantom lines to emphasize the inflow and exhaust system of the invention.

Referring now to FIGS. 9 through 14, alternate embodiments of a dryer oven A′ according to the invention are illustrated. As can best be seen in FIG. 9, the invention contemplates the deletion of reducing plenum I, redirecting means J, diffuser manifold means K, and air equalizing chamber 0 as illustrated in FIG. 3. It has been determined that the hot air registers E, F with nozzle system G and tubes 22, as can best be seen in FIG. 4, provides an air discharge of sufficient uniformity that the reducing plenum, redirecting structure, and diffuser manifold are not needed in many applications. In the alternate embodiment of dryer oven A′, three blower fans 110, 112, 114, may be utilized (FIG. 10). The fans discharge air through heating coils 111, and corresponding heating coils (not shown) in front of blowers 112 and 114. The air is discharged directly to a tapered plenum 16 through nozzles G and air tubes 22 where it is returned to the blowers 110 through 114 by way of slots 50, air tubes 22, and return chamber 118 as in the first described embodiment (FIG. 3). This description applies to upper oven housing 120, the same description applies to lower oven housing 120*a* which is an exact duplicate of housing 120, and which includes blowers 110*a*, 112*a*, 114*a* (FIG. 15). Air from blower 110*a* is delivered through lower housing air tubes 22, around nozzle G, through air tubes 22, lower air return chamber 118*a* to lower fan 110*a*. Faster drying performance is achieved if all of the air supplied by the blower fans is returned exactly to the fan. Accordingly, one end 122 of air tubes 22 is sealed by a plate 124 or 124*a*. This avoids any interchange between the top plenum 116 and lower plenum 116*a*. At the return chambers 118 and 118*a* which are on the suction side of blower 110 and 110*a*, and which are sealed by plates 126 and 126*a*. This arrangement seals air tubes 22 for a direct, positive return of air to blowers 110 through 114 and 110*a* through 114*a*, on lower dryer housing 120*a*. Front plates 127, 127*a* close the front part of the air return chambers and receive the ends of tubes 22 in a manifold arrangement. An oven door 128 is hinged at 129 to upper housing 120 and rotates to seal an opening 130 and 130*a* in the rear of return chambers 118 and 118*a*, respectively. Thus, air return chambers 118, 118*a* are closed chambers except for openings 130, 130*a*. Air cylinders 132 are mounted to hinged door 128 to automatically open the doors by a small amount to introduce ambient air to intake chambers 118 and 118*a* for quickly cooling the interior of the dryer oven. Opening of door 128 allows unrestricted return air, blowing any lint accumulated inside the dryer to the outside which provides an automatically cleaning dryer oven. The close proximity of heating elements 111 to the discharge of the blowers allows the full force of the blower to clean the heater coils. Thus, the oven has many desirable self-cleaning features. As discussed, in regards to FIGS. 3, 6, and 9, door 128 pivots (FIGS. 7, 9) to open and close the air return chamber. When the door closes, it seals the air return chambers.

When the door opens, it allows access for cleaning the interior of the air chambers and tubes 22. In operation, the top of the dryer can be opened in operation without substantial temperature loss, due to the fact that the air 26 (FIG. 4) flows direct to slot 50, therefore, the heated air, even with the top open, remains synonymous with the upper section of the dryer, and the same applies with the bottom.

A major advantage of this oven construction is that with some fabrics, primarily of pile constructions, totally isolated temperatures can be maintained between one side and the other side of the fabric without any significant transfer between them. This is increasingly important to such fabrics as dyed, after coating and or heat setting. The higher temperatures used to affect heat setting, degrade the loose ends of pile fabrics and greatly alter their dye affinity, but in accordance with the invention, the temperature of each fabric side can be controlled with very little interchange between them. What this means is, that temperatures to 400 degrees can be applied to one side of the fabric and effectively heat set this side, and maintain the face side (sensitive side) at less than 150 degrees, by not having any heat on the bottom section of the dryer. Another advantage is that a defined air fluid bed is provided within the area of nozzles G without side movements. This is advantageous in cases where the tenter frames are not used, fabrics do not have the tendency to walk to the fan suction side. In the case where tenters are used, if the fabrics become detached during the tentering, they are not sucked in to the fan suction, causing damage and safety hazards.

Figure 14:
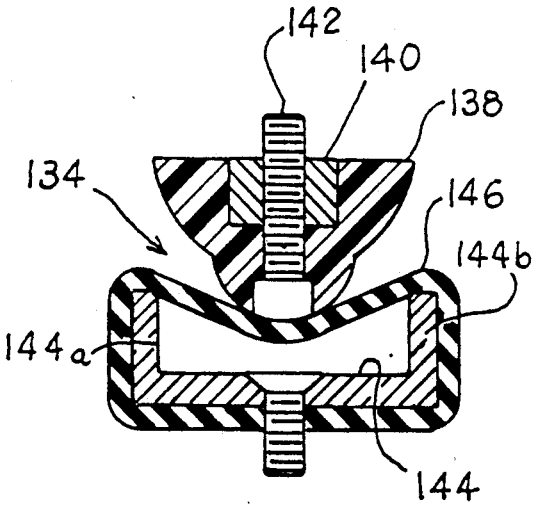
FIG. 14 is a sectional view of a bridge seal for a dryer oven constructed in accordance with the present invention.
Figure 15:
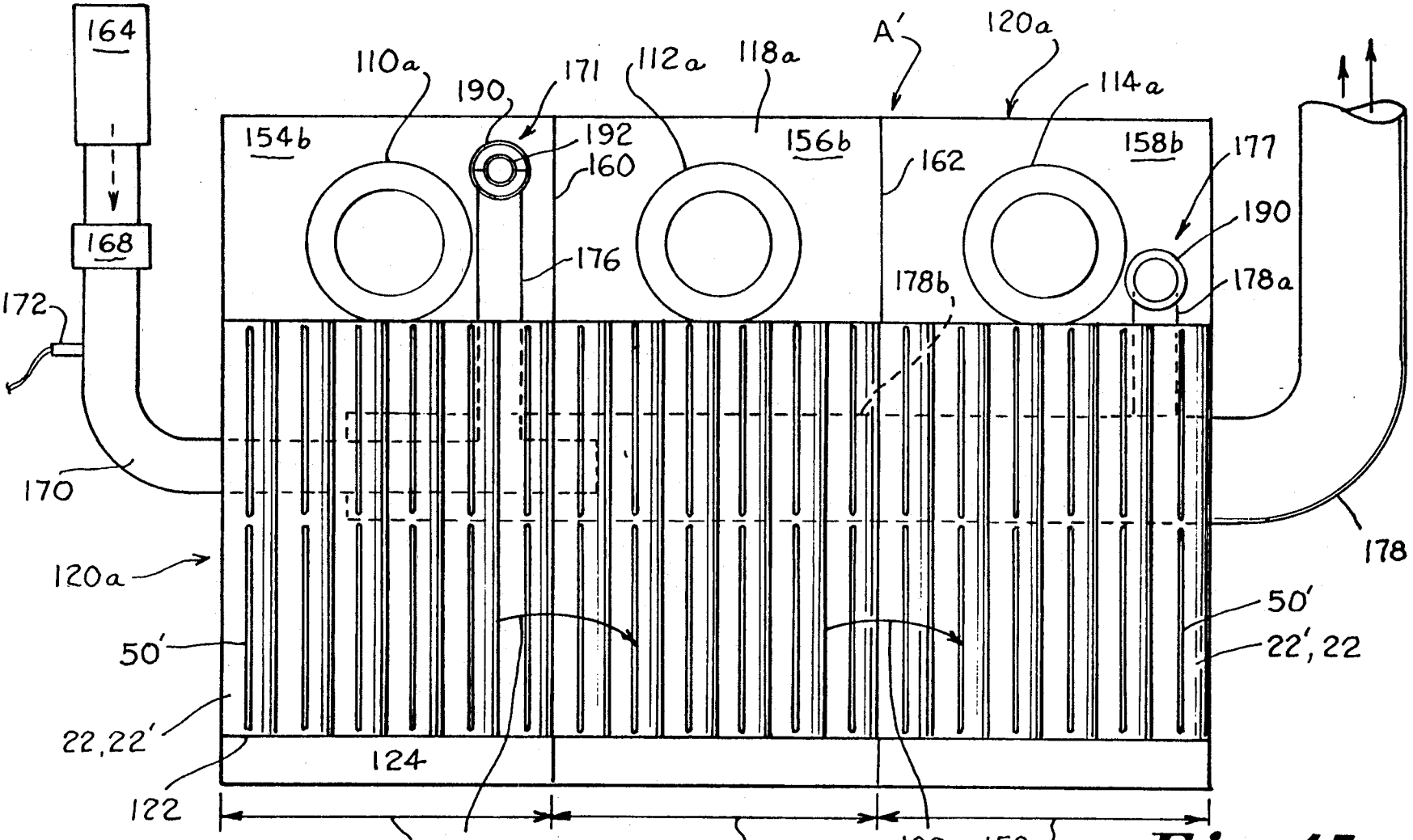
FIG. 15 is a top plan view of the lower oven housing constructed according to the invention.

As can best be seen in FIG. 14, a suspension seal, designated generally as 134 is disclosed for sealing the longitudinal front edge 136 of the dryer between the top and bottom sections. Suspension seal 134 includes an upper seal which includes a suitable sealing element 138 that may be a molded silicone seal with a rigid stiffener 140 that may be aluminum. This upper sealing element is attached by means of a threaded bolt 142 to upper dryer section 120. A lower sealing element includes a channel 144 having a first side 144*a* and a second side 144*b*. A resilient tube 146, which may be a silicone rubber tube, encases channel 144 and extends between the legs of channel 144 in a suspended manner. When top dryer section 120 is lowered, silicone sealing element 138 contacts tube 146 and tension maintains tube 146 and element 138 tight together for effective sealing.

An improved hinge system, designated generally as N is provided which provides a better balance of the heavy top section 120. A hinge point is located at 148 for a "question mark" shaped plate 150 having a shank 150*a* pivoted at lower housing 120*a*, and a curved arm 150*b* attached to top section 120 by any suitable means (FIG. 10). This hinge arrangement and location allow the motor and blower weight to be countered to off-set the weight of the overhung dryer plenums. A spring loaded air cylinder 152 provides additional opening power, or the drive can be automatically opened by air pressure to the cylinder.

With the omission of the first stage diffuser K, three blowers are utilized in each of the upper and lower oven housings, instead of the previous two blowers as are shown in FIG. 2. In the case of the alternate embodiment, it is preferred to divide the dryer into three sections, 154, 156, and 158 by the addition of plates 160 and 162, as can best be seen in FIG. 15. This separates air return chamber 118*a* into a plurality of separate air return chambers 154*a*, 156*a*, and 158*a* in lower housing 120*a* (FIG. 15). Likewise, air return chamber 118 in upper housing 120 includes three separate air return housings 154*b*, 156*b*, and 158*b* (FIG. 10). The separate air return chambers each correspond to described air chambers 118, 118*a*. The air return chambers of the separate drying sections are isolated from fluid communication with one another while the hot air registers E,F of the drying sections are in fluid communication. It has been discovered that with the unique air nozzle system G, the dryer can float flexible web W and support the web in mid air as web W travels through the oven. However, with exhaust added to the oven, a portion of this support is lost, as a negative suction is greater than the positive discharge. In accordance with the invention, an improved exhaust system is provided which admits fresh air into the dryer by blower 164, as can best be seen in FIGS. 10 and 15, which is equal to the amount of air removed by an exhaust air blower 166. This keeps the dryer in equilibrium with respect to pressure. A heater 168 may be utilized to heat the air as it enters the oven (FIG. 15). It is desirable to move the air through the dryer in the same direction as web W travels to fully saturate the exhaust air and increase the humidity contact. This improves the moisture extraction of the dryer. In addition, the higher humidity level of the dryer interior provides a softer fabric. Additionally, by injecting water or steam into fresh air intake duct 170, an injection nozzle 172 can be utilized to improve fabric hand. Plates 160 and 162 separate the respective return chambers 154*a*, 156*a*, 158*a* by feeding fresh air to section 154 by air tube 22,22′ (FIG. 15). Intake air enters an intake port assembly 171 into air return chambers 154*a*. Excess air 189 then cascades from section 154 to 156 and likewise from section 156 to 158 where it is removed by exhaust port assembly 177 through tube 178*a* eventually to exhaust duct 178. Fresh intake duct 170 is internal to duct 178 which exhausts air out to effect a heat transfer from the cold intake air and the hot exhaust air. As an alternative to FIG. 10, exhaust duct 178 and blower 166 may be on the opposite end of the oven so that the entire flow of exhaust air from port 177 may flow through duct 178*b* over internal intake tube 170.

Referring to FIG. 10, the drier air is at the web inlet end of dryer A′ as the web travels in the direction as shown by arrow 181. In some applications, it may be desirable that the minor air currents move through the dryer oven in a direction opposite to the travel of web W. It is contemplated that the intake and exhaust may be reversed at port assemblies 171 and 177 so that the drier air is at the web outlet end of dryer A′. Means for establishing drier air at the web outlet end also may be done simply by reversing the direction of web travel shown by arrows 181, so that the air and fabric travel in opposite directions.

Pressure differential in the dryer can be adjusted by the differences in fan speed between equal positive and negative as desired. In long dryer, several sections of A' connected together, intake air and exhaust air may be equally proportioned by use of damper valves at each section. Air movement from the front to the rear circulates in the direction of web flow to facilitate web flow through the oven. Stagnate air pockets are avoided.

Figure 11:
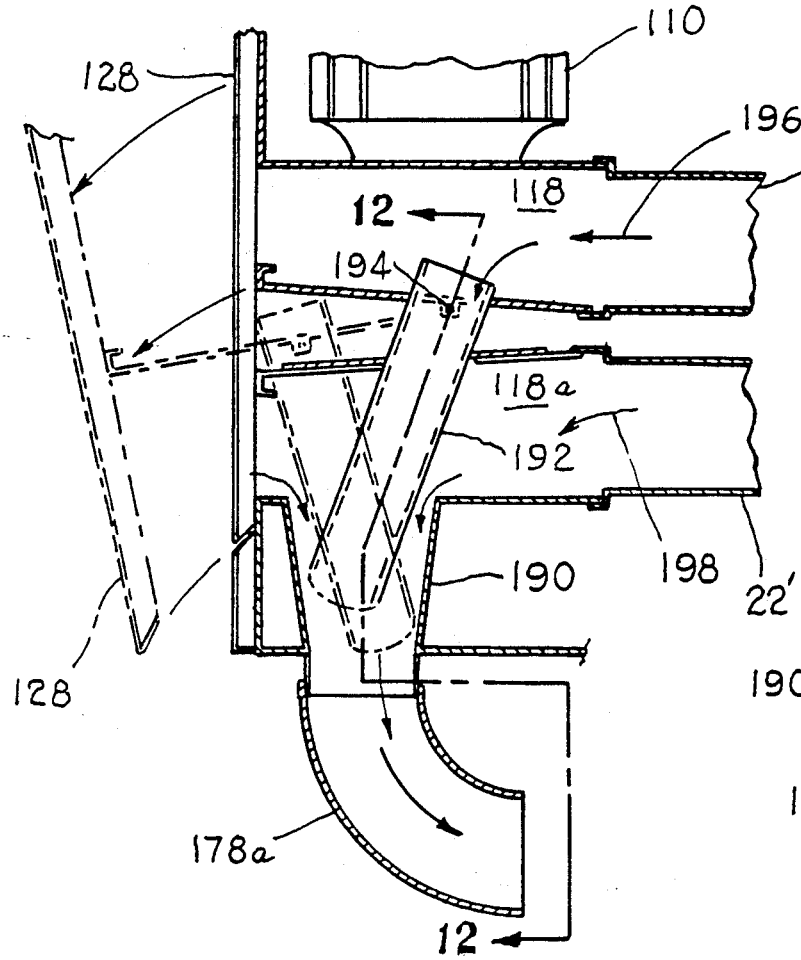
FIG. 11 is a partial sectional view of an intake assembly and an exhaust assembly for the alternate embodiment of FIG. 9.
Figure 12:
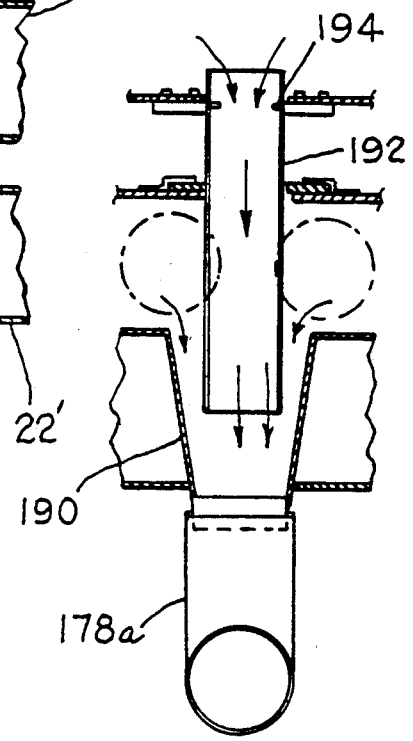
FIG. 12 is a sectional view taken along line 12—12 of FIG. 11.

As can best be seen in FIGS. 11 and 12, wherein dryer housings 120 and 120*a* may be fed and exhausted by a single port. Each port 171, 177 includes a tapered cone 190 connected to tube 176 or 178. There is a feeder tube 192 having a small diameter which is free to slide in the cone 190. Feeder tube 192 is hinged at 194 at the top thereof and pivots about the hinge to slide in and out of cone 190. In this manner, air 196 which is exhausted from upper dryer housing 120 may pass through cone 190. Air 198 exhausted from lower dryer section 120*a*, may pass directly through cone 190 to be exhausted. The same is true of the intake air from intake tube 176.

Figure 13:
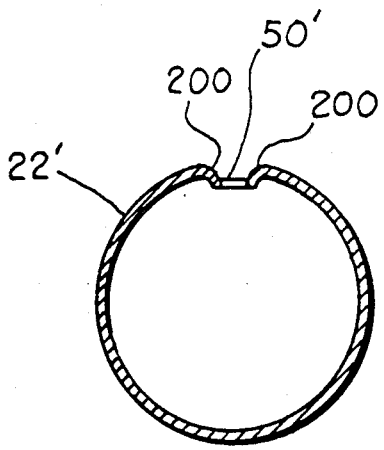
FIG. 13 is a sectional view of an air tube for use in a dryer oven according to the invention.

As can best be seen in FIG. 13, an alternate design for air tubes 22 is illustrated which facilitates floating of web W through the dryer. In the alternate embodiment of FIG. 13, the upper walls adjacent slot 50' of tube 22' are flattened at 200 on either side of slot 50'. This provides a wider slot 50', reducing the velocity of the air entering 50' and negative pressure at the slot entrance. This reduces the tendency of the web to be sucked toward the air tube and facilitates floating of web W through the dryer.

While a preferred embodiment of the invention has been described using specific terms, such description is for illustrative purposes only, and it is to be understood that changes and variations may be made without departing from the spirit or scope of the following claims.

What is claimed is:

1. A compact dryer oven for drying a travelling web and the like comprising:

pair of superposed oven housings between which said web travels for drying, each of said housings including a hot air discharge means for supplying hot air, an air plenum means disposed above said travelling web for delivering said hot air across a width of said web; and a series of individual drying sections defined in succession in said hoven housings collinear with said web travel wherein each drying section includes:

an air return chamber, a hot air register through which said hot air is distributed across said width of said web;

a blower means associated exclusively with said section for forcing said hot air through said air plenum means and said hot air register, and;

air return means associated exclusively with said section for returning air from said hot air register to said air return chamber.

2. The apparatus of claim 1 including means for successively creating greater negative pressures in each of said drying sections in the direction of said web travel to provide a minor air flow between adjacent drying sections in said oven housing substantially collinear with said web travel through said oven.

3. The apparatus of claim 2 wherein said means for creating said negative pressures includes:

a fresh air intake port means carried in an intake drying section; and an exhaust air port means carried in an exhaust drying section downstream from said intake drying section whereby each of said drying sections is maintained at a progressively greater negative pressure than the other sections upstream.

4. The apparatus of claim 3 wherein each of said port means comprises a first air duct in communication with said lower housing, a second air duct in communication with said upper housing, and said second air duct being disposed within said first air duct.

5. The apparatus of claim 3 wherein said intake port means is connected to an intake duct, and said exhaust air port means is connected to an exhaust duct, said intake duct and said exhaust air duct being disposed in heat exchange relations so that said intake air is preheated by said exhaust air.

6. The apparatus of claim 1 including means for establishing drier air at a web entrance end of said oven.

7. The apparatus of claim 1 including means for establishing drier air at a web outlet end of said oven.

8. The apparatus of claim 1 wherein said hot air register comprises a plurality of hollow tubular members having an open interior through which air is passed upon return to said air return chamber.

9. The apparatus of claim 8 comprising an air dividing nozzle carried between adjacent tubular members for splitting said hot air passing between said tubular members to a first air flow and a second air flow generally in opposite directions.

10. The apparatus of claim 8 wherein one end of said hollow tubular members is connected to said air return chamber and the opposite end of said tubular member is closed.

11. The apparatus of claim 1 wherein said air return chamber constitutes an enclosure which includes an opening on the backside of said enclosure, a movable door means carried over said openings of said air return chambers of said upper and lower housings, and means for opening said movable door means to provide access to said tubular members through said air return chamber.

12. The apparatus of claim 8 wherein each said air return chamber comprises:

a first side wall, a back side wall, a second side wall opposite said front side wall integral with said back side wall, and a front side wall in which said ends of said tubular members are manifolded for return of said air to said air return chamber, and said second side walls forming partitions between adjacent air return chambers.

13. The apparatus of claim 12 wherein said back side wall of said air return chambers includes an opening which may be opened to facilitate cooling of said oven and provide access to said tubular members for cleaning through said air return chambers.

14. The apparatus of claim 11 wherein each of said drying sections includes an individual blower for forcing air through said drying section.

15. The apparatus of claim 1 wherein said air return chambers of adjacent ones of said drying sections are effectively isolated from one another with respect to fluid communication, and said hot air registers of said adjacent drying sections are in open fluid communication with one another.

16. A compact dryer oven for drying a travelling web comprising:

a lower oven housing;

an upper oven housing disposed in superposed relation with said lower housing; and a generally closed air circulation loop in each of said upper and lower oven housings which includes:

(i) an air return chamber, (ii) air blower means for forcing hot air through said loop, (iii) an air delivery plenum means receiving said hot air, (iv) a hot air register receiving hot air from said plenum means which includes a plurality of elongated tubular members extending transverse to the direction said web travels, said tubular members being spaced in the direction of web travel so that air may pass between said tubular members for drying said web, and (iv) each of said tubular members including air return openings through which air may enter an interior of said tubular member, one end of said tubular member being in fluid communication with said air return chamber so that air circulates in said loop from said air return chamber through said delivery plenum means, between said tubular members for drying said web, and substantially all of said air passes through an interior of said tubular members after contacting said web to said air return chamber;

whereby said upper oven housing and said lower oven housing can be operated at isolated and different temperatures to maintain one side of said web at a first temperature and a second side of said web at a second temperature.

17. The apparatus of claim 16 wherein said upper housing is pivotally mounted about a pivot axis and said lower housing which is fixed, and said tubular members extend generally orthogonal to said pivot axis.

18. The oven of claim 17 wherein said air return chamber constitutes an enclosure which includes an opening on a backside of said enclosure;

a movable door means carried over said openings of said upper and lower air return chambers; and means for opening said movable door means for quickly cleaning the interior of said upper and lower dryer housings, and for providing access to said air return chamber tubular members for cleaning.

19. The apparatus of claim 16 wherein said air return openings extend generally along the entire length of said tubular members to facilitate return of substantially all of said air through said interior of said tubular members to said air return chamber.

20. The apparatus of claim 16 including an air intake and exhaust system comprising an intake air port means carried near a first end of said oven, and an exhaust port means carried near a second end of said oven remote from said first end, said intake port means being connected to a source for admitting air to said oven, and said exhaust port means being connected to a negative pressure source for removing air from said oven.

21. The apparatus of claim 20 wherein said first end of said oven is a web entrance end.

22. The apparatus of claim 20 wherein said first end of said oven is a web outlet end.

23. A compact dryer oven for a traveling web which may be easily cleaned without entering the oven and which is reduced in interior space for more efficient drying, said oven comprising:

a pair of superposed oven housings between which said web travels for drying;

hot air discharge means carried in each said housing for discharging hot air into said housing;

air plenum means carried in each said housing extending longitudinally in the direction of web travel, said air plenum means receiving said discharged hot air for delivering said air across the width of said web; and a hot air register carried below said plenum means which includes a plurality of longitudinally spaced tubular members extending transverse to said plenum means and said direction of web travel, and air dividing nozzle means carried between adjacent tubular members for splitting said hot air passing between said adjacent tubular members into a first air flow and a second air flow generally in opposite directions.

24. The apparatus of claim 23 wherein said tubular members include air return slots spaced equidistantly from said nozzle body and in close proximity there to for exhausting said fist and second air flows as return air, and one end of said tubular members being attached to an air return chamber for returning at least a portion of said air to said hot air discharge means.

25. The apparatus of claim 23 wherein said tubular members include cylindrical tubes having narrow slots formed along the length of said cylindrical tubes defined by opposing edges of said cylindrical tubes, and air velocity reducing means formed near said edges which reduce the negative pressure at said slots to reduce suction of said web toward said slots and facilitate web floating and travel through said oven.

26. The apparatus of claim 25 wherein said air velocity reducing means comprises said edges being deformed inwardly forming a tapering air opening.

27. The oven of claim 23 wherein said air dividing nozzle means includes:

a divider body;

a first nozzle opening between said adjacent tubular members upstream of said divider body;

a second nozzle opening between said divider body and said adjacent tubular members having an area less than the area of said first nozzle opening so that said hot air increases in velocity;

an expansion zone following said second nozzle opening having an area greater than said second nozzle to decrease the velocity of said hot air;

a third nozzle between said divider body and said adjacent tubular members having an area less than the area of said expansion zone to increase the velocity of hot air; and said series of increasing, decreasing and increasing velocities of hot air balancing the distribution of hot air delivered through said lower and upper hot air registers so that web is evenly dried.

28. The apparatus of claim 23 including air return slots extending longitudinally along the length of said tubular members generally facing said web for return of air from said first and second air flows, one end of said tubular members being connected to an air return chamber which supplies air to said air discharge means, and an opposite end of said tubular members being closed so that substantially all of said air is delivered to said air return chamber.

29. The apparatus of claim 23 wherein said air discharge means includes:

first blower means carried in said upper housing and second blower means carried in said lower housing for discharging air respective ones of said housings; and heater means for heating air discharged from said blower means.

30. The apparatus of claim 29 wherein said first blower means includes a first plurality of blowers spaced between an entrance and exit end of said lower housing; said second blower means includes a second plurality of blowers arranged between an entrance and exit end of said upper housing, and said first and second plurality of blowers being carried adjacent a side wall of said lower and upper housings for discharging air across said web and said housings from said side to an opposite side.

31. A compact dryer oven for a traveling web which may be easily cleaned without entering the oven and which is reduced in interior space for more efficient drying, said oven comprising:

a fixed lower oven housing;

a movable upper oven housing disposed above said lower oven housing;

pivot means for pivotally carrying said upper oven housing above said lower oven housing between a closed position for web drying and an open position in which said upper housing is raised for access to an interior of said lower and upper oven housings for cleaning of said interior;

said lower and upper oven housings having respective lower and upper housings facing and opposed from one another, and said web traveling across said lower and upper housing openings through said oven;

a lower hot air register carried generally co-extending across said lower housing opening and an upper hot air register carried generally co-extending across said upper housing opening from which hot air is delivered for contacting and drying the sides of said web; and each said oven housing having a first end wall at which said web enters said housing, a second remote end wall at which said web exits said housing, an oven back side extending between said first and second end walls on a back of said upper and lower oven housings, and an oven front side extending between said first and second end walls on a front of said upper and lower oven housings so that a plurality of said ovens may be joined in adjacent series with said first end walls and said second end walls of adjacent ovens being next to one another to provide a generally continuous dryer oven having an overall effective length corresponding to the dimension of said plurality of dryer ovens joined together for generally continuous drying of said web.

32. The apparatus of claim 31 wherein said pivot means includes a lever arm having a shank pivotally carried by said lower housing, a curved arm affixed to said upper housing in a manner to affect and counter the weight of said upper housing.

33. The apparatus of claim 32 including actuating means connected to said lever arm and said lower housing for assisting in the raising of said upper housing to said open position.

34. The apparatus of claim 31 comprising a suspension seal for sealing opposing longitudinal edges of said upper and lower housings which comprises a first sealing element carried by one of said oven housings; a second sealing element carried by the other of said oven housings; said second sealing element comprising a flexible member suspended between a pair of spaced supports; and said first sealing member contacting said resilient second member between said spaced supports when said upper and lower housings are in said closed position to deform said resilient member inwardly suspended by said space supports to form an effective seal.

35. A dryer oven having an upper housing and lower housing comprising:

pivot means for pivotally carrying said upper oven housing above said lower oven housing between a closed position for web drying and an open position in which said upper housing is raised for access to an interior of said lower and upper oven housings for cleaning of said interior;

a suspension seal for sealing opposing edges of said upper and lower housings wherein said suspension seal comprises:

a first sealing element carried by one of said oven housings;

a second sealing element carried by the other of said oven housings;

said second sealing element comprising a flexible member suspended between a pair of spaced supports; and said first sealing member contacting said resilient second member between said spaced supports when said upper and lower housing are in said closed position to deform said resilient member inwardly suspended by said spaced supports to form an effective seal.

36. The apparatus of claim 35 wherein said oven comprises:

lower and upper housing openings formed in said respective lower and upper housings, said lower housing opening facing said upper housing opening, and said web traveling across said lower and upper housing openings through said oven; and a lower hot air register carried generally co-extending across said lower housing opening and an upper hot air register carried generally co-extending across said upper housing opening from which hot air is delivered for contacting and drying the sides of said web.

* * * * *